US007785071B1

(12) United States Patent
Liang

(10) Patent No.: US 7,785,071 B1
(45) Date of Patent: Aug. 31, 2010

(54) TURBINE AIRFOIL WITH SPIRAL TRAILING EDGE COOLING PASSAGES

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 608 days.

(21) Appl. No.: 11/809,324

(22) Filed: May 31, 2007

(51) Int. Cl.
*F01D 5/18* (2006.01)

(52) U.S. Cl. ..... 416/97 R

(58) Field of Classification Search ..... 416/96 R, 416/97 R

See application file for complete search history.

(56) References Cited

U.S. PATENT DOCUMENTS 3,819,295 A 6/1974 Hauser et at
4,080,095 A 3/1978 Stahl
4,183,716 A 1/1980 Takahara et al.
4,203,706 A 5/1980 Hess
4,407,632 A 10/1983 Liang
4,684,322 A * 8/1987 Clifford et al. ..... 416/95
6,164,912 A 12/2000 Tabbita et al.
7,114,923 B2 10/2006 Liang
2003/0143075 A1 * 7/2003 Fleck ..... 416/97 R

* cited by examiner

*Primary Examiner*—Edward Look
*Assistant Examiner*—Dwayne J White
(74) *Attorney, Agent, or Firm*—John Ryznic

(57) ABSTRACT

A turbine airfoil such as a rotor blade or a stator vane with a row of spiral shaped cooling holes in the trailing edge region of the airfoil to provide cooling to the trailing edge region. An up-pass or last leg of a serpentine flow cooling channel extends along the trailing edge region of the airfoil and a row of the spiral cooling holes are connected to the supply channel to bleed off cooling air. The spiral cooling holes have a decreasing diameter in the airfoil streamwise direction and a constant diameter in the spanwise direction of the airfoil such that the spiral cooling holes are close to the pressure side and suction side walls of the airfoil in the trailing edge region. The cooling air flow increases in momentum as the trailing edge narrows and the spiral cooling holes decrease in diameter to enhance the heat transfer coefficient and provide better cooling in the hotter region of the trailing edge region where the airfoil is relatively thinner.

7 Claims, 1 Drawing Sheet

TURBINE AIRFOIL WITH SPIRAL TRAILING EDGE COOLING PASSAGES

BACKGROUND OF THE INVENTION

1. Field of the Invention

The present invention relates generally to air cooled turbine airfoils, and more specifically to the cooling of a turbine airfoil trailing edge.

2. Description of the Related Art Including Information Disclosed Under 37 CFR 1.97 and 1.98

In a gas turbine engine, a turbine section includes a plurality of stages of stator vanes and rotor blades to convert chemical energy from a hot gas flow into mechanical energy by driving the rotor shaft. The engine efficiency can be increased by passing a higher gas flow temperature through the turbine section. The maximum temperature passed into the turbine is determined by the first stage stator vanes and rotor blades.

These turbine airfoils (stator vanes and rotor blades) can be designed to withstand extreme temperatures by using high temperature resistant super-alloys. Also, higher temperatures can be used by providing internal convection cooling and external film cooling for the airfoils. Complex internal cooling circuits have been proposed to maximize the airfoil internal cooling while using a minimum amount of pressurized cooling air to also increase the engine efficiency.

Besides allowing for a higher external temperature, cooling of the airfoils reduces hot spots that occur around the airfoil surface and increase the airfoil oxidation and erosion that would result in shorter part life. This is especially critical in an industrial gas turbine engine where operation times hot between engine start-up and shut-down is from 24,000 to 48,000 hours. Unscheduled engine shut-down due to a damaged part such as a turbine airfoil greatly increases the cost of operating the engine.

Airfoils constructed with cavities and passageways for carrying cooling fluid there through are well known in the art. For example, it is common to construct airfoils with spanwise cavities within the wider forward portion. These cavities often have inserts disposed therein which define compartments and the like within the cavities. The cooling fluid is brought into the cavities and compartments and some of the fluid is often ejected there from via holes in the airfoil walls to film cool the external surface of the airfoil. The trailing edge region of airfoils is generally more difficult to cool than other portions of the airfoil because the cooling air is hot when it arrives at the trailing edge since it has been used to cool other portions of the airfoil, and the relative thinness of the trailing edge region limits the rate at which cooling fluid can be passed through that region.

A common technique for cooling the trailing edge region is to pass cooling fluid from the larger cavity in the forward portion of the airfoil through the trailing edge region of the airfoil via a plurality of small diameter drilled passageways. Such an airfoil construction is shown in U.S. Pat. No. 4,183,716 issued to Takahara et al on Jan. 15, 1980 and entitled AIR-COOLED TURBINE BLADE. Another common technique for convectively cooling the trailing edge region is by forming a narrow slot between the walls in the trailing edge region and having the slot communicate with a cavity in the forward portion of the airfoil and with outlet means along the trailing edge of the airfoil. The slot carries the cooling fluid from the cavity to the outlets in the trailing edge. An array of pedestals extending across the slot from the pressure to the suction side wall are typically incorporated to create turbulence in the cooling air flow as it passes through the slot and to increase the convective cooling surface area of the airfoil.

The rate of heat transfer is thereby increased, and the rate of cooling fluid flow required to be passed through the trailing edge region may be reduced.

Another airfoil constructed with improved means for carrying cooling fluid from a cavity in the forward portion of the airfoil through the trailing region and out the trailing edge of the airfoil is shown in U.S. Pat. No. 4,203,706 issued to Hess on May 20, 1980 and entitled RADIAL WAFER AIRFOIL CONSTRUCTION. In that patent wavy criss-crossing grooves in opposing side walls of the trailing edge region provide tortuous paths for the cooling fluid through the trailing edge region and thereby improve heat transfer rates.

Another prior art airfoil with a trailing edge cooling passage is U.S. Pat. No. 3,819,295 issued to Hauser et al on Jun. 25, 1974 and entitled COOLING SLOT FOR AIRFOIL BLADE which discloses an intersecting arrangement of cooling passages formed by turbulators extending from the side walls of the trailing edge of the airfoil to promote turbulence in the cooling air passing through the trailing edge.

In U.S. Pat. No. 4,407,632 issued to Liang on Oct. 4, 1983 and entitled AIRFOIL PEDESTALED TRAILING EDGE REGION COOLING CONFIGURATION, the airfoil trailing edge region is cooled by a plurality of slots formed between the pressure and suction side walls with an array of pedestals extending across the slot such that the cooling air snakes around the pedestals in a spiral-like or vortex-like flow path to improve the heat transfer from the hot airfoil wall to the cooling air.

Despite the variety of trailing edge region cooling configurations described in the prior art, further improvement is always desirable in order to allow the use of higher operating temperatures, less exotic materials, and reduced cooling air flow rates through the airfoils, as well as to minimize manufacturing costs.

An object of the present invention is to provide for a turbine airfoil with an improved convective cooling configuration in the trailing edge region.

BRIEF SUMMARY OF THE INVENTION

A turbine airfoil with a spiral trailing edge cooling passages extending along the trailing edge from the platform to the blade tip to provide enhanced cooling for the trailing edge region. An internal cooling air up passage supplies cooling air to the row of spiral passages. Each spiral passage has an entrance region of larger diameter in the airfoil streamwise direction than at the exit region such that the spiral becomes tighter in the direction of flow toward the trailing edge. The spiral passage in the spanwise direction maintains a constant spiral diameter from inlet to exit. With this shape of spiral passage, cooling air accelerates through the spiral flow channel as the radius of curvature becomes tighter and the diameter gets smaller, and therefore increases the flow channel heat transfer performance from the flow channel entrance to the exit.

DETAILED DESCRIPTION OF THE INVENTION

The present invention is a turbine airfoil, such as a rotor blade or a stator vane, used in a gas turbine engine in which the airfoil requires cooling air. Turbine blades and vanes include complex internal cooling circuits to provide a high level of convection and film cooling for the airfoil while using a low amount of pressurized cooling air in order to allow for the airfoil to be exposed to a high gas flow temperature while directing adequate amounts of cooling air to specific parts of the airfoil to prevent hot spots. Too much cooling of a certain area of the airfoil will waste cooling air, while too little cooling could lead to over-heating and damage to the airfoil from creep or other problems that would shorten the airfoil life.

Figure 1:
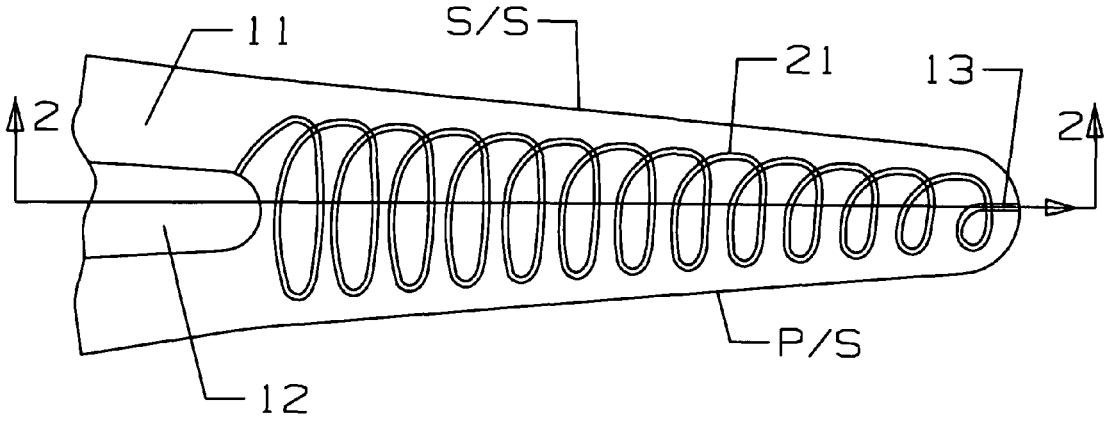
FIG. 1 shows a cross section view from the top of the trailing edge spiral cooling passage of the present invention.
Figure 2:
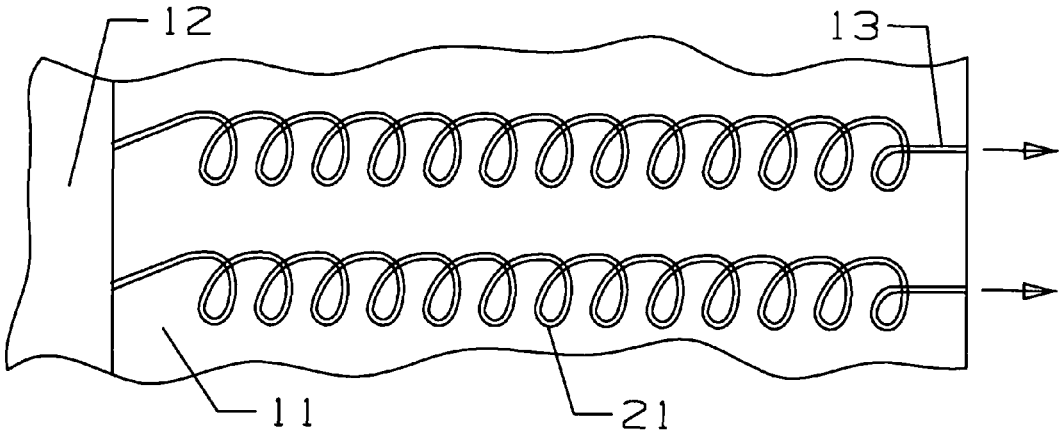
FIG. 2 shows a side view of the trailing edge spiral passage of FIG. 1.

The present invention makes use of a spiral shaped cooling passage for the trailing edge region of the airfoil in order to provide increased levels of cooling for this region while using no more amount of cooling air than the cited prior art references. FIGS. 1 and 2 show various views of a single spiral cooling passage used in the present invention. FIG. 1 shows a top view of the trailing edge spiral cooling passage 21 formed within the airfoil 11 and extending between an up-pass cooling supply channel 12 and a trailing edge exit hole or slots 13. The pressure side and the suction side of the airfoil are labeled in FIG. 1. In the present invention, the cooling air supplied to the spiral cooling passage 21 is an up-pass cooling channel 12. However, other internal cooling circuits can be used in which the cooling air can be supplied to the spiral passages.

The spiral cooling passage 21 includes an inlet end and an outlet or exit end. As seen in FIG. 1, the spiral cooling passage 21 has a larger diameter (of the spiral passage and not the diameter of the passage that spirals around an axis) from at the inlet end adjacent to the up-pass cooling supply channel 12 than at the exit end. The spiral diameter of the spiral cooling passage progressively decreases in the direction of the cooling air flow through the passage 21 in the streamwise direction of the airfoil. The spiral cooling passage 21 in the FIG. 1 cross section follow the walls of the airfoil on the pressure and suction sides such that the distance from the wall to the spiral cooling passage remains substantially constant along the spiral cooling passage 21 from the inlet end to the exit end. In the FIG. 1 view, the spiral cooling passage 21 has a larger turn diameter in the inlet end and a tighter turn diameter in the exit end. The spiral passage has a central axis that extends along a direction parallel to the streamwise direction of the airfoil.

FIG. 2 shows a cross section view of the spiral cooling passage 21 of FIG. 1 from the side view as indicated by the arrows in FIG. 1. The diameter of the spiral cooling passage 21 in the spanwise direction shown in FIG. 2 is substantially constant from the inlet end to the outlet end.

In a turbine airfoil such as a turbine blade used in an industrial gas turbine engine, a row of these spiral shaped cooling passages 21 would be located along the trailing edge region of the blade extending from the platform to the blade tip. Each spiral cooling passage would be connected to an internal cooling channel within the blade to supply cooling air through the spiral passages. Each spiral cooling passage would be cast into the blade according to the well known investment casting processes for manufacturing turbine blades. Each spiral cooling passage is a two dimensional convergent elliptical shaped passage. The turns for the spiral flow channel are at tight radius of curvature formation next to the airfoil pressure and suction side surfaces. The change of cooling flow momentum functions to enhance the channel heat transfer performance.

Cooling air is fed through the up-pass of an internal serpentine or a single up-pass radial channel within the blade and then bleeds into the spiral flow channel and finally exits through the airfoil trailing edge. The cooling air accelerates through the spiral flow channel as the radius of curvature becomes tighter and the diameter decreases, which increases the channel flow internal heat transfer performance from the flow channel entrance to the exit. At the entrance region of the spiral flow channel where the radius of curvature is larger and the airfoil wall is thicker or wider, the airfoil external heat load is not as high as the trailing edge end corner. Thus, demand for the channel internal heat transfer coefficient lower than for the trailing edge corner. As the cooling air flows into the trailing edge corner, the radius of curvature for the spiral flow channel decreases and the change of cooling air momentum rapidly increases which augments the internal channel heat transfer coefficient to a much higher level prior to the cooling air discharging through the exit hole. Trip strips positioned along the spiral cooling channels can also be used in the channel at the higher airfoil external heat load areas to enhance the heat transfer rate.

Major design features and advantages of the spiral cooling channels of the present invention over the prior art straight cooling channels or triple impingement cooling designs are described below. The convergent spiral flow channel modulates the cooling flow and pressure to the airfoil trailing edge region. Cast-to-flow cooling technique can be applied to the airfoil trailing edge region. Casting of the trailing edge spiral flow channel eliminates the casting of triple impingement cooling circuits and therefore minimizes fragile ceramic cores and breakage of ceramic cores which improves manufacturing yields. The convergent spiral flow channel cooling approach can be tailored to the external airfoil heat load to achieve desirable spanwise and streamwise metal temperature distribution. The spiral channel airfoil trailing edge cooling approach can be cast with a smaller diameter than the geometry requirement for a typical multiple impingement cooling circuit. Cooling of the airfoil trailing edge can be achieved with a lower cooling flow rate. A simpler casting technique produces a lower cost trailing edge design. Smaller cooling holes can be used for the spiral trailing edge channel cooling design than cast multi-impingement cooled trailing edge design. This yields a higher heat transfer convective surface and a higher heat transfer coefficient. High internal heat transfer is created at the turns and the trailing edge exit region where higher cooling amounts for the airfoil is needed. Acceleration of cooling flow within the convergent spiral flow channel creates higher rate of heat transfer for the airfoil trailing edge region which is inline with the airfoil external heat load.

I claim:

1. A turbine airfoil for use in a gas turbine engine, the airfoil comprising:

a leading edge region and a trailing edge region;

a pressure side wall and a suction side wall both extending between the leading and the trailing edge regions;

a cooling supply channel extending along the trailing edge region of the airfoil; and, a plurality of trailing edge cooling holes to provide cooling to the trailing edge region of the airfoil, the trailing edge cooling holes having a spiral shape with a central axis of the spirals extending along a streamwise direction of the airfoil.

2. The turbine airfoil of claim 1, and further comprising:

the spiral of the cooling hole has a variable diameter that decreases in the direction of cooling air flow through the spiral cooling hole.

3. The turbine airfoil of claim 2, and further comprising:

the spiral of the cooling hole diameter varies in the airfoil streamwise direction and remains constant in the airfoil spanwise direction.

4. The turbine airfoil of claim 2, and further comprising:

in the airfoil streamwise direction, the diameter of the spiral of the cooling hole substantially follows the pressure and suction side walls such that the spacing between the spiral cooling hole and the side walls are constant.

5. The turbine airfoil of claim 1, and further comprising:

trip strips located within the spiral cooling holes to promote heat transfer to the cooling air.

6. The turbine airfoil of claim 1, and further comprising:

the spiral cooling hole extends from the cooling supply channel to the trailing edge exit hole.

7. The turbine airfoil of claim 1, and further comprising:

the spiral cooling holes are cast into the airfoil.

* * * * *